US005997732A

United States Patent [19]

Yenni et al.

[11] Patent Number: 5,997,732

[45] Date of Patent: Dec. 7, 1999

[54] CLAY TREATMENT PROCESS FOR WHITE MINERAL OIL

[75] Inventors: Nadine Yenni, Sonoma; Chan Vu, Rodeo, both of Calif.

[73] Assignee: Chevron U.S.A. Inc., San Francisco, Calif.

[21] Appl. No.: 09/172,744

[22] Filed: Oct. 14, 1998

Related U.S. Application Data

[60] Provisional application No. 60/068,412, Dec. 22, 1997.

[51] Int. Cl.[6] ..... C10G 25/00; C10G 67/06

[52] U.S. Cl. ..... 208/307; 208/299; 208/301; 208/303; 208/306; 208/99

[58] Field of Search ..... 208/99, 299, 301, 208/303, 306, 307

[56] References Cited

U.S. PATENT DOCUMENTS

| | | | |
|---|---|---|---|
| 3,459,656 | 8/1969 | Rausch | 208/57 |
| 3,553,107 | 1/1971 | Donaldson et al. | 208/271 |
| 3,629,096 | 12/1971 | Divijak, Jr. | 208/89 |
| 3,818,105 | 6/1974 | Coopersmith et al. | 424/358 |
| 4,024,026 | 5/1977 | Gewartowski | 203/2 |
| 4,053,367 | 10/1977 | Gewartowski | 203/2 |
| 4,072,603 | 2/1978 | Wentzheimer | 208/264 |
| 4,240,900 | 12/1980 | Gilbert et al. | 208/143 |
| 4,251,347 | 2/1981 | Rausch et al. | 208/57 |
| 4,263,127 | 4/1981 | Rausch et al. | 208/58 |
| 4,325,804 | 4/1982 | Everett et al. | 208/58 |
| 5,019,662 | 5/1991 | Vora et al. | 585/323 |
| 5,057,206 | 10/1991 | Engel et al. | 208/143 |
| 5,098,556 | 3/1992 | Go et al. | 208/299 |
| 5,202,455 | 4/1993 | Schmitz | 558/313 |
| 5,294,327 | 3/1994 | Everett | 208/57 |
| 5,393,408 | 2/1995 | Ziemer et al. | 208/57 |
| 5,453,176 | 9/1995 | Narloch et al. | 208/58 |

FOREIGN PATENT DOCUMENTS

| | | |
|---|---|---|
| 1 476 428 | 6/1977 | United Kingdom . |
| WO98/02242 | 1/1998 | WIPO . |

OTHER PUBLICATIONS

D. R. Taylor and D. B. Jenkins "Acid–activated clays", Society of Mining Engineers of AIME, Transactions, vol. 282–1905, No Date Available.

Technical information, "Highly active granular bleaching clay", TONSIL® CO 630G, No Date Available.

Technical information, "Highly active granular bleaching earth", TONSIL® CO 614G, pp. 1–2. No Date Available.

Technical information, "Highly active granular bleaching earth", TONSIL® CO 616G, pp. 1–2. No Date Available.

*Primary Examiner*—Walter D. Griffin

*Attorney, Agent, or Firm*—Alan W. Klaassen

[57] ABSTRACT

Severely contaminated white mineral oils which fail the RCS specification are treated using an acid-treated bentonite clay, such as TONSIL CO 630G. The white oil products produced in the treatment may be a USP grade white oil.

25 Claims, 2 Drawing Sheets

Color Scale Comparison for Approximate Conversions

CLAY TREATMENT PROCESS FOR WHITE MINERAL OIL

This application claims priority from U.S. Provisional application Ser. No. 60/068,412, filed Dec. 22, 1997, the entire disclosure of which is incorporated herein by reference for all purposes.

BACKGROUND OF THE INVENTION

The present invention relates to a process for preparing a USP grade white oil by filtering through a specified clay sorbent.

A white oil produced in the present process meets the requirements of regulation 21 CFR 172.878, 21 CFR 178.3620(a), 21 CFR 178.3620(b) or 21 CFR 178.3620(c) for USP and technical grade white oils. White mineral oil is prepared from a distillate of petroleum crude oil which has a viscosity in the lubricating oil range and a normal boiling point above 350° F. Preparation of the white oil generally includes one or more upgrading steps for purifying the oil and for removing the contaminants which degrade the properties of the oil as a white oil. Common upgrading steps include refining processing such as hydrotreating, hydrogenation, filtering, solvent refining and/or dewaxing. A final step for removing the last traces of contaminants may include one or more hydrogenation reaction steps, an acid treatment step and/or a final filtering step. The traditional method for making white mineral oil has been treatment of the distillate with acid. Traditionally, the distillate was treated with acid, and purified by clay treatment to remove by-products that have been created by the acid treatment. U.S. Pat. No. 4,024,026 and U.S. Pat. No. 4,053,367 disclose removing impurities, such as olefinic materials, from hydrocarbons by clay treating. Common contact materials for clay treating are acidic aluminosilicates, either naturally occurring materials, such as bauxite or mordenite clay, or a synthetic material and may comprise alumina, silica, magnesia or zirconia or some other compound which exhibits similar properties. Typical clays which are taught as being suitable include Filtrol 24, Filtrol 25, Filtrol 62, Attapulgus clay and TONSIL clay.

White mineral oils have also been prepared using hydrogenation processes. U.S. Pat. No. 3,459,656 to Rausch discloses a process for preparing technical grade and food grade white mineral oils by catalytic hydrogenation in two steps. The catalyst of the first hydrogenation operation is taught as being any of the sulfur resistant non-precious metal hydrogenation catalysts. The catalyst of the second hydrogenation is a platinum group metal-promoted catalyst. U.S. Pat. No. 5,294,327 discloses three stages of hydroprocessing without any solvent extraction or acid treatment prior steps to produce a desired food grade quality white mineral oil.

While a hydrogenation process may produce acceptable white oil during normal operation, it may produce "off-spec" product as a result of, for example, a process upset or a feed change. Such off-spec product may then require a second treatment in order to pass all of the requirements of a USP grade white oil, at additional expense and process complexity. U.S. Pat. No. 5,098,556 partly addresses the issue of off-spec oil by disclosing a process for removing the RCS present in off-spec white oil produced by catalytic hydrogenation by contacting the off-spec oil with a bleaching clay, such as a smectite clay, particularly an acid-treated montmorillonite clay, such as bentonite or attapulgite. According to the '556 patent, a white oil having an RCS value of approximately 2.5–3.5 is considered off specification, but treatable by clay purification. A white oil with an RCS value of 4 or over generally was found to be untreatable. Clay treatment of the white oil reduced the RCS value to under 2.5. The '556 patent does not clearly explain the number value attributed to the RCS test.

The determination of readily carbonizable substances (RCS) in a white mineral oil is described in ASTM D565-88 (Reapproved 1993). The test includes extracting a white oil sample with $H_2SO_4$, and evaluating the color of the oil layer and acid layer following extraction. A white oil sample is considered as having passed the RCS test when the oil layer shows no change in color and when the acid extract layer is no darker than the reference standard colorimetric solution. However, while not required by the test, the acid extract layer may be further analyzed for color, using, for example, the ASTM Color Scale (ASTM D1500-96) or the Gardner Color Scale (ASTM D1544-80: reapproved 1989). As used herein, the term "RCS value" refers to the color of the acid extract from the acid extract layer. Unless otherwise indicated, the color is referenced to the ASTM color scale, and is indicated by a number per the ASTM color scale.

The '556 process is limited to white oils having an RCS value of 2.5–3.5. However, conditions beyond the control of the refiner may result in production of a more severely contaminated white oil. It is desirable to have an inexpensive and efficient process for upgrading such more severely contaminated off-spec oils without having to resort to additional hydrogenation or to other more costly and difficult methods.

SUMMARY OF THE INVENTION

It is therefore an object of the present invention to provide an improved process for preparing a USP grade white oil from a technical white oil at low cost and high throughput. It is another object of the invention to provide an improved process for preparing a white oil from a hydrogenated white oil feedstock having a high RCS value. It is another object of the present invention to provide an improved process for preparing a white oil from a petroleum distillate. It is another object of the present invention to provide a method for filtering a technical grade white oil having a high RCS value to produce an acceptable USP grade white oil at low cost and high efficiency. These and other objects will be apparent to those skilled in the art who practice the invention as described herein.

Accordingly, the present invention provides a process for preparing a white oil comprising filtering a white oil feedstock through a filter bed containing an acid-activated clay to produce a white oil, wherein the white oil feedstock, when subjected to the RCS test per ATSM D565-88, produces an acid extract having an ASTM D 1500 color of greater than 4.5, and wherein the white oil, when subjected to the RCS test, produces an acid extract having an ASTM D1500 color of 2.5 or less.

The white oil prepared in the process meets the RCS requirement for a USP grade white oil. The preferred white oil prepared in the process is a USP grade white oil. A preferred acid-activated clay is acid-activated calcium bentonite. A most preferred acid-activated calcium bentonite is TONSIL CO 630G.

In a further embodiment, the white oil feedstock is derived from a step of filtering a mineral oil feedstock through a regenerable sorbent. This embodiment provides a process for preparing a white oil comprising:

a) contacting a mineral oil feedstock in a first sorbent stage with a regenerable clay sorbent to produce a white oil feedstock which, when subjected to the RCS test, produces an acid extract having an ASTM D1500 color of greater than 4.5; and b) contacting the white oil feedstock from step a) with a non-regenerable clay sorbent to produce a USP grade white oil which, when subjected to the RCS test, produces an acid extract having an ASTM D1500 color of less than about 2.5.

A preferred regenerable clay sorbent is bauxite. A preferred non-regenerable clay sorbent is an acid-activated clay. A more preferred non-regenerable clay sorbent is an acid-activated calcium bentonite. A most preferred non-regenerable clay sorbent is TONSIL CO 630G.

In a separate embodiment, the white oil feedstock is derived from a hydrogenation process. This embodiment provides a process for preparing a white oil comprising:

a) contacting a mineral oil feedstock and hydrogen at hydrogenation reaction conditions with a hydrogenation catalyst to produce a hydrogenated effluent, which, when subjected to the RCS test, produces an acid extract having an ASTM D1500 color of greater than 4.5; and b) filtering at least a portion of the hydrogenated effluent through a filter bed comprising an acid-activated calcium bentonite to produce a white oil, which, when subjected to the RCS test, produces an acid extract having an ASTM D1500 color of 2.5 or less.

The preferred hydrogenation catalyst comprises a platinum-palladium alloy and an oxide matrix, wherein the platinum to palladium molar ratio in the alloy is between 2.5:1 to 1:10.

As disclosed herein, the preferred process utilizes a clay sorbent having specific physiochemical properties. In a further embodiment therefore, a process is provided for preparing a white oil comprising passing a white oil feedstock through a filter bed comprising an acid-activated calcium bentonite having the following properties:

| | |
|---|---|
| Bulk density, g/l | 400–700 |
| Free moisture (2 h, 110° C.), % max | <8% |
| Loss on ignition (2 h, 1000° C.), % max | <12% |
| pH (10% suspension, filtered) | 2.0–4.0 |
| Free Acidity, mg KOH/g | 2.5–3.5 |
| Total Acidity, mg KOH/g | 7.0–13.0 |
| Surface area, $m^2/g$ | 150–350 |
| Micropore volume (0–80 nm), ml/g | 0.20–0.40 |
| Particle size | >90% through 16 mesh (1 mm)<br><10% through 80 mesh (180 μm) |

to produce a white oil which, when subjected to the RCS test, produces an acid extract having an ASTM D1500 color of 2.5 or less.

Among other factors, the present invention is based on the discovery of a process for preparing a USP grade white oil from a severely contaminated white oil feedstock using clay filtering. The present process provides an inexpensive and effective alternative to more difficult and costly processes such as additional stages of hydrogenation or acid treatment. The clay filtering step includes use of a clay which has been found to be surprisingly effective in lowering the RCS value of a white oil feedstock to an acceptable level in the preparation of USP grade white oil. Conventional sorbents commonly taught for this purpose, when used to treat the same highly contaminated white oil feeds, do not produce acceptable white oil. In particular, the present process provides an inexpensive and effective method for upgrading a white oil to a USP specification white oil after it has become severely contaminated during an upset in manufacturing or during shipment.

IN THE DRAWINGS

FIG. 1 compares the sorption capacity of various clays for removing color from a 100 neutral lube base oil.

FIG. 2 is a color scale comparison for approximate conversions between the ASTM (D 1500) color scale and the Gardner (D 1544) color scale.

DETAILED DESCRIPTION OF THE INVENTION

Figure 1:
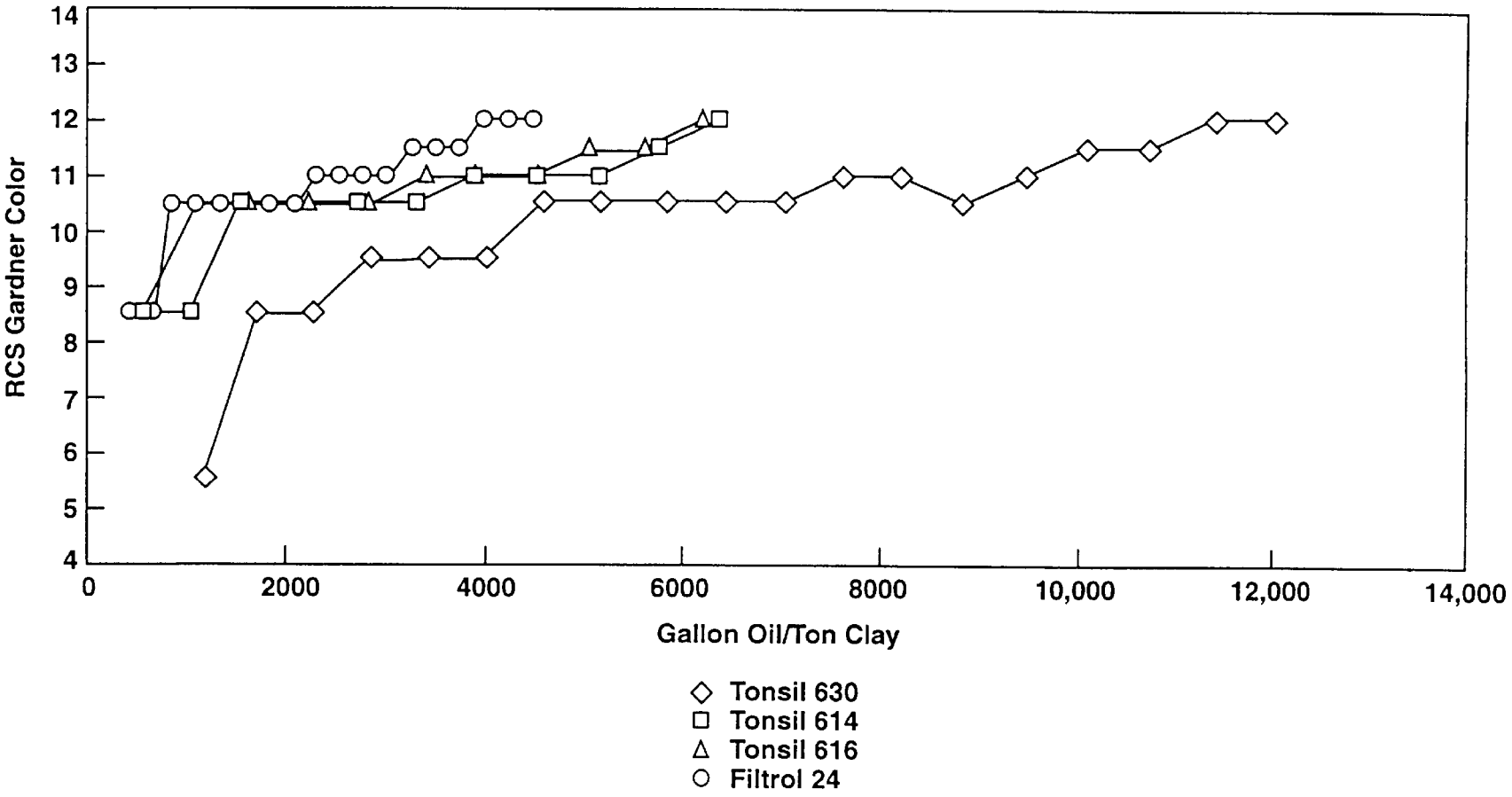

The present process comprises treating a white oil feedstock through a fixed bed of contact material selected for removing certain undesirable contaminants from the feedstock. Clay treating, alternatively known as clay filtering, is used herein to refer to the passage of a liquid phase hydrocarbon stream through a fixed bed of contact material, which possesses the capability of removing contaminants from the liquid phase hydrocarbon. Such contaminants include color bodies, molecules having specific ultraviolet absorbances, single and multi-ring aromatics, and the like. In the present process, the acid-activated clay has a surprisingly high affinity for such contaminants. Thus, using the present clay filtering step, high quality white oils may be consistently produced at low operating cost.

The process for removing contaminants is identified herein as a sorption or adsorption process. The contact material is identified as a sorbent or adsorbent, and the removed contaminant identified as a sorbate or adsorbate. Use of the terms sorption, adsorption, or related terms refer to removal of the contaminant by the fixed bed of contact material, and does not imply or is not limited to a specific chemical mechanism by which the contaminant is removed.

White oil is defined herein as a mineral oil which may be safely used in food/food packaging. It is a mixture of liquid hydrocarbons, essentially paraffinic and naphthenic in nature obtained from petroleum. A white oil produced in the present process meets the requirements of U.S. Regulation 21 CFR 172.878, 21 CFR 178.3620(a), 21 CFR 178.3620(b) or21 CFR 178.3620(c), all refer to Apr. 1, 1996 edition, for USP and technical grade white oils, which regulations of its Apr. 1, 1996 edition are incorporated herein by reference. A USP grade white oil is refined to meet the test requirements of the United States Pharmacopeia (U.S.P.) XX (1980), at page 532, for readily carbonizable substances. It also meets the test requirements of U.S.P. XVII for sulfur compounds at page 400. The white oil prepared in the present process, when subjected to the RCS test per D565-88 (Reapproved 1993), produces an acid extract having an ASTM D1500 color of 2.5 or less or with a color per the Gardner color scale of 10 or less.

USP grade white mineral oil is required to be colorless, odorless when cold, tasteless, insoluble in water and alcohol, nearly free of fluorescence and neutral to litmus. It must also pass tests for readily carbonizable substances, for polynuclear compounds and for 0° C. solid paraffins. Technical white oils meet somewhat less severe requirements. The white oil produced by the present process has a normal boiling point above 350° F., preferably above 450° F., and more preferably above 550° F. and has a viscosity which falls in a broad range from about 4 to about 120 cSt at 40° C. For use in association with food and food packaging, the initial boiling point is preferably 450° F. or greater and has a Saybolt color of 20 minimum as determined by ASTM D156-82. Generally, the white oil is classified by viscosity grade. Though it is not required for all white oils, it may be preferable in some cases that the viscosity index of the dewaxed oil product be at least about 60, preferably at least about 70, more preferably at least about 80, and still more preferably at least about 95.

Suitable white oils meet the specifications prescribed in the "Journal of the Association of Official Analytical Chemists," Volume 45, page 66 (1962) after correction of the ultraviolet absorbance for any absorbance due to added antioxidants. White mineral oil may contain any antioxidant permitted in food in an amount not greater than that required to produce its intended effect. White mineral oil is used or intended for use as follows: as a release agent, binder, and lubricant in or on capsules and tablets containing concentrates of flavoring, spices, condiments, and nutrients intended for addition to food, excluding confectionery; as a release agent, binder, and lubricant in or on capsules and tablets containing food for special dietary use; as a float on fermentation fluids in the manufacture of vinegar and wine to prevent or retard access of air, evaporation, and wild yeast contamination during fermentation; as a defoamer in food; in bakery products, as a release agent and lubricant; in dehydrated fruits and vegetables, as a release agent; in egg white solids, as a release agent; on raw fruits and vegetables, as a protective coating; in frozen meat, as a component of hot-melt coating; as a protective float on brine used in the curing of pickles; in molding starch used in the manufacture of confectionery; as a release agent, binder, and lubricant in the manufacture of yeast; as an antidusting agent in sorbic acid for food use; as release agent and as sealing and polishing agent in the manufacture of confectionery; and as a dust control agent for wheat, corn, soybean, barley, rice, rye, oats, and sorghum. White oil may also be used as a plasticizer or as an extender for polymers, as an adhesive for food packaging, or as a caulk or sealant. White oil also may be used as a component in cosmetics and toiletries, such as hand and body lotions, sun care products, lipstick, make-up, make-up remover, cold cream, hair care products, in super fatted soaps and in bath oils.

The white oil feedstock is treated in the process of this invention to meet the requirements set forth for a white mineral oil. This treatment step largely removes aromatics to improve the UV properties of the oil. In this process, molecules giving odor and color to the oil are also removed. The solid adsorbent used for filtering the oil is generally in the particle size range of 250–2000 microns. If desired, the oil may be heated during the treatment with the solid adsorbent, preferably in the range of 50° C. to 300° C., more preferably in the range of 50° C. to 120° C. Optionally, an inert gas such as nitrogen may be passed through the oil. As a rule, the quantity of oil treated by the solid adsorbent according to the present process lies between 2,000 gallons of oil per ton of adsorbent to about 80,000 gallons of oil per ton of adsorbent, preferably between 5,000 and 40,000 gallons per ton, more preferably between 7,500 and 20,000 gallons per ton before the adsorbent must be regenerated or replaced. The preferred process comprises treating the white oil feedstock in a single clay filtering step.

In the present process, a white oil feedstock is filtered through a filter bed containing clay or clay-like materials which are particularly suited for removing RCS precursors, especially single and double ring aromatics and olefins. A preferred clay is non-regenerable, by which is meant that the clay is not easily, at least to an economically attractive extent, regenerated by solvent washing, by heating and/or by other methods known in the art for removing the contaminant load from the sorbent and returning the sorbent to its desired activity and capacity for preparing the white oil product.

The preferred sorbent in the present process is an acid-activated clay. Acid-activated clays are generally described in D. R. Taylor and D. B. Jenkins, *Acid-activated Clays,* Society of Mining Engineers of AIME (Transactions), vol 282, p. 1901–1910, the entire disclosure of which is incorporated herein by reference. An acid-activated clay is defined as a nonswelling bentonite that has been treated with mineral acid to enhance its capacity for adsorbing pigments from oils. A bentonite is a clay ore whose principal mineral in montmorillonite, an end-member of the smectite clay mineral goup characterized by a three-layered structure composed of two silica sheets sandwiches about a central alumina sheet. A typical, non-limiting, formula of montmorillonite is:

$$Si_8(Al_{3.34}Mg_{0.66})O_{20})OH)_4.0.66\ Na$$

A particularly preferred sorbent for preparing the white oil according to the invention is an acid-activated calcium bentonite clay. While mixtures of clay are suitable for the present invention, the preferred clay is an acid-activated calcium bentonite clay having the following properties.

TABLE I

| | Characteristic | Preferred |
|---|---|---|
| Bulk density, g/l | 400–700 | 450–650 |
| Free moisture (2 h, 110° C.), % | <8% | <8% |
| Loss on ignition (2 h, 1000° C.), | <12% | <12% |
| pH (10% suspension, filtered) | 2.0–4.0 | 2.2–3.2 |
| Free Acidity, mg KOH/g | 2.5–3.5 | 2.5–3.5 |
| Total Acidity, mg KOH/g | 7.0–13.0 | 8.0–13.0 |
| Surface area, $m^2/g$ | 150–350 | 200–300 |
| Micropore volume (0–80 nm), | 0.20–0.40 | 0.25–0.35 |
| Particle size | >90% through 16 mesh (1 mm) <10% through 80 mesh (180 μm) | >90% through 16 mesh (1 mm) <10% through 80 mesh (180 μm) |

An acid activated clay from Sud-Chemie Indonesia, with product name TONSIL CO 630G, is a preferred clay for this application. Characteristic properties of TONSIL CO 630G areas follows:

TABLE II

| Physical Properties | |
|---|---|
| Bulk density, g/l | 500–600 g/l |
| Free moisture (2 h, 110° C.), % | <6% |
| Loss on ignition (2 h, 1000° C.), | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2/g$ | 230–250 m |
| Micropore volume (0–80 nm), | 0.30–0.35 |
| Particle size | >90 wt % through 20 mesh (850 μm) <10% through 60 mesh (250 μm) |
| **Chemical Analysis (average values)** | |
| $SiO_2$ | 71.86% |
| $Al_2O_3$ | 14.07% |
| $Fe_2O_3$ | 2.75% |
| CaO | 0.64% |
| MgO | 1.46% |
| $Na_2O$ | 0.08% |
| $K_2O$ | 0.66% |
| Loss on ignition | 6.65% |
| Total | 98.17% |

As set forth in Table II above, the chemical analysis is based on a sample dried at 110° C. for 2 hours.

The white oil produced using the present process is further characterized as having a surprisingly low concentration of single-ringed aromatic compounds when compared with white oils prepared using conventional processes.

The white oil feedstock to the present process, when subjected to the RCS test per D565-88 (Reapproved 1993), produces an acid extract having an ASTM D1500 color of greater than 4.5, or greater than 5.0, or even greater than 6.0. The white oil feedstock has a boiling point generally above about 350° F. and a viscosity, measured at 100° C., of greater than about 3.5 cSt and preferably greater than about 6 cSt. The feedstock is generally derived from a distillate of petroleum crude oil. A preferred feedstock has been upgraded using, for example, hydrotreating, hydrogenation, filtering, solvent refining and/or dewaxing prior to treatment using the present process.

In particular, the white oil feedstock in the present process may be prepared by hydrogenating a suitable petroleum feedstock over a hydrogenation catalyst.

Hydrogenation is typically conducted at temperatures ranging from about 190° C. to about 400° C., at pressures of from about 400 psig to about 4000 psig (2.76–27.6 MPa), at space velocities (LHSV) of from about 0.1 to about 20 $hr^{-1}$, and hydrogen recycle rates of from about 400 to about 20,000 standard cubic feet per barrel (SCF/bbl) of lubricating oil base stock (60.6–3030 liters $H_2$/kg oil). The hydrogenation catalyst employed must be active enough not only to hydrogenate the olefins, diolefins and color bodies within the white oil fractions, but also to reduce the content of any aromatics present to a suitably low level.

Suitable hydrogenation catalysts include conventional, metallic hydrogenation catalysts, particularly the Group VI metals such as tungsten and molybdenum and Group VIII metals such as cobalt, nickel, palladium and platinum. The metals are typically associated with carriers such as bauxite, alumina, silica gel, silica-alumina composites, and crystalline aluminosilicate zeolites. Palladium and/or platinum are preferred hydrogenation metals. If desired, non-noble Group VIII metals can be used with molybdates. Metal oxides or sulfides can be used. Suitable catalysts are disclosed in U.S. Pat. Nos. 3,852,207; 4,157,294; 3,904,513; and 4,673,487, which are incorporated herein by reference.

The hydrogenation step is beneficial as a first stage in removing aromatics, color bodies, and sources of odor which must be removed before the product will qualify as a technical or USP grade white mineral oil. Depending on the quality of the refinery stream feedstock to the present white oil process or the severity of the processing conditions of the dewaxing step and/or the hydrogenation step, the hydrogenated oil product from the hydrogenation step may meet some or all the requirements of at least one of regulations 21 CFR 172.878, 21 CFR 178.3620(a), 21 CFR 178.3620(b) or 21 CFR 178.3620(c) for food grade and technical grade white oils. A suitable hydrogenation process is described in U.S. Pat. No. 5,393,408, the entire disclosure of which is incorporated herein by reference for all purposes. A particularly preferred hydrogenation catalyst includes a platinum-palladium alloy and an oxide matrix, wherein the molar ratio of platinum to palladium in the alloy is between about 2.5:1 and about 1:10, preferably between about 2:1 and about 1:5 and most preferably the platinum to palladium ratio is between 1:1 and 1:4. Such a catalyst and hydrogenation process is disclosed in U.S. application Ser. No. 08/883,006, the entire disclosure of which is incorporated herein by reference for all purposes.

Alternatively, the white oil feedstock may be prepared using a clay filter pretreatment. Examples of suitable solid adsorbents for pretreating include bauxite, Fuller's earth, attapulgite, montmorillonite, halloysite, sepiolite, and other clays having adsorption and decolorizing properties, whether or not activated with acid. The solid adsorbent used for pretreating the oil is generally in the particle size range of 250–2000 microns. If desired, the oil may be heated during pretreatment with the solid adsorbent, preferably in the range of 50° C. to 300° C., more preferably in the range of 50° C. to 120° C. Optionally, an inert gas such as nitrogen may be passed through the oil. As a rule, the quantity of oil pretreated by the solid adsorbent according to the present process lies between 2,000 gallons of oil per ton of adsorbent to about 80,000 gallons of oil per ton of adsorbent, preferably between 5,000 and 40,000 gallons per ton, before the adsorbent must be regenerated or replaced.

The preferred sorbent for the pretreating step is preferably a regenerable sorbent. Such a regenerable sorbent may be regenerated numerous times without significant loss in sorption performance. Bauxite is one suitable regenerable sorbent for the present process. Regenerating the adsorbent includes one or more of heating the adsorbent to drive off the sorbent, and/or contacting the adsorbent with a second solvent to remove the sorbate.

A regenerable sorbent such as bauxite is useful to, for example, remove aromatics, improve the Saybolt color of the finished white oil, and extend the useful life of the present filter bed. However, such a regenerable sorbent generally has little effect on the RCS value. Thus, while a bed of regenerable sorbent may be used prior to the filter bed of the present invention, it is not required in the present process. Indeed, the preferred bentonite clay of the invention has been found to also improve the Saybolt color of the finished white oil, thus eliminating the need for a multi-bed system in many applications of the present process.

Suitable pretreatment processes may also include, for example, one or more of hydrocracking, hydrotreating, solvent extraction, and/or dewaxing to lower the pour point. Dewaxing may be carried out by conventional means known in the art such as, for example, by solvent dewaxing or by catalytic dewaxing. Catalytic dewaxing processes which may be useful in the present process are well known in the art, e.g. U.S. Pat. No. 5,282,958, the entire disclosure of which is incorporated herein by reference for all purposes. Dewaxing processes using a catalyst containing SAPO-11 are disclosed, for example, in U.S. Pat. Nos. 4,859,311; 4,921,594; 5,149,421; and 5,413,695. Dewaxing processes using a catalyst containing SSZ-32 are disclosed, for example, in U.S. Patent Nos. 5,300,210; 5,397,454; and 5,376,260.

An upgraded mineral oil feedstock prior to hydrogenation preferably contains less than about 200 ppm sulfur and about 100 ppm nitrogen, and has a viscosity index of greater than about 80, with a viscosity index of greater than 85 and even greater than 90 being preferred. Dewaxed feedstock to the hydrogenation process generally has a pour point of less than 10° C., with pour point less than 0° C. and even less than −5° C. being more preferred.

EXAMPLES

Table III lists the sorbents which were tested for decreasing the RCS value of various white oil feedstocks in the preparation of USP grade white oil.

TABLE III

| Sorbent | Description |
|---|---|
| Activated Carbon | A commercially available activated carbon |
| SLD 350 | Alumina catalyst base from Alcoa |
| Attapulgus Clay | A commercially available magnesium aluminum silicate from Floridin |
| F-24 | Acid activated bentonite from Engelhard (formerly Filtrol Grade 24) |
| Florosil | Synthetic magnesia-silica gel catalyst from U.S. Silica Company, PO box 187, Berkeley Springs, WV 25411 |
| Hydrotreating Catalyst | Commercial catalyst containing 2% Nickel, 6% Molybdenum, 0.8% Phosphorous on an alumina support. |
| Porocel 20/60 | Bauxite from Engelhard |
| TONSIL CO 614 G | Acid-Activated Calcium Bentonite from Sud-Chemie AG |
| TONSIL CO 616 G | Acid-Activated Calcium Bentonite from Sud-Chemie AG |
| TONSIL CO 630 G | Acid-Activated Calcium Bentonite from Sud-Chemie Indonesia |

Example 1

Figure 2:
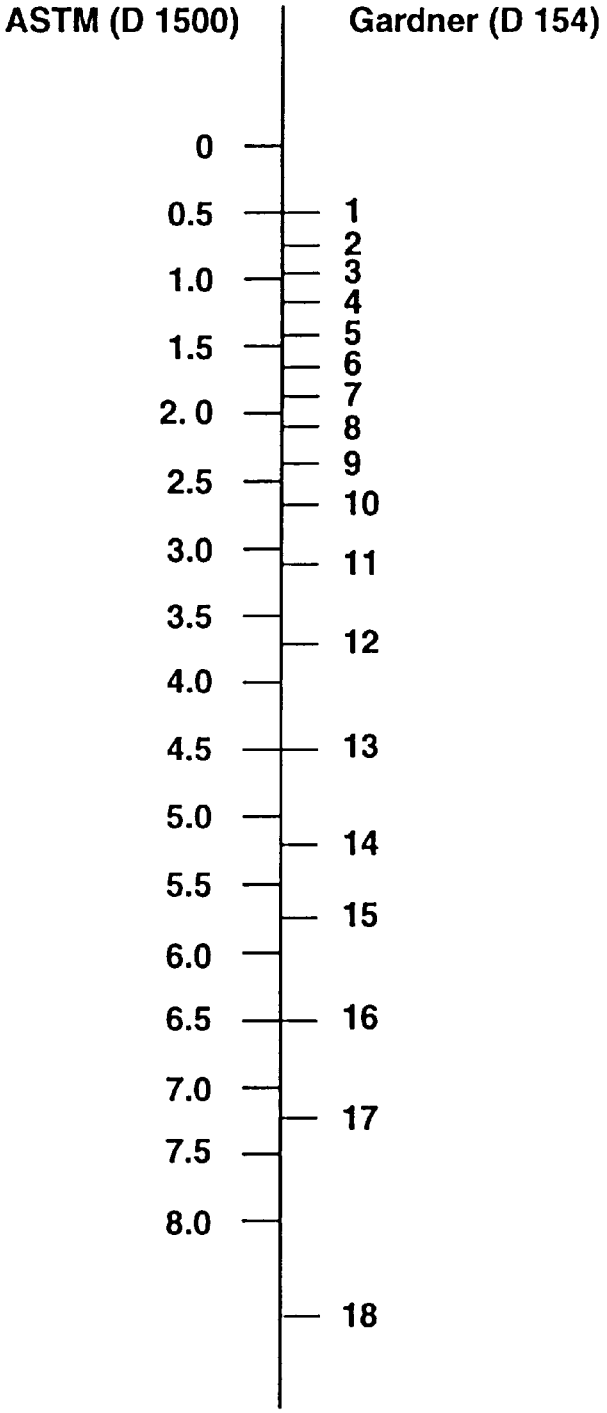

A 500 Neutral Lube Base Stock was passed through a two-bed filtering system at a rate of between 9 and 12 drops per minute, with each bed containing 75 grams of the indicated sorbent (either Porocel 20/60 bauxite or TONSIL CO 630G acid-activated calcium bentonite). A bauxite bed was used in the multi-bed tests to remove aromatics and color bodies and to extend the life of the TONSIL sorbent bed. The test was then repeated using 100 Neutral Lube Base Stock. Results are tabulated in Table IV. In Table IV the RCS result for the base stock before filtering is indicated in the "No Treat" column. ASTM color units, where reported, are enclosed in parenthesis. FIG. 2 shows a color scale comparison for converting between the ASTM D1500 color scale and the Gardner D1544 color scale.

For each test summarized in Table IV, the base stock was filtered through the filtering system for the indicated number of hours. At designated times, samples of filtered oil were collected and subjected to the RCS test. The acid extract layer was analyzed for color, using the ASTM color scale and/or the Gardner color scale. The test sample was considered to have passed the RCS test if the Gardner color of the acid layer after treatment was 11.0 or less. Alternatively, the test sample was considered to have passed the RCS test if the ASTM color of the acid layer after treatment was 2.5 or less. The RCS test method included shaking together 5 ml of oil and 5 ml of sulfuric acid in a stoppered graduated cylinder (Pyrex 2982) with a nominal inside diameter of 1.7 cm. The color of the acid layer per the Gardner color scale was determined by comparing the color of the acid layer in the graduated cylinder with the color of the standard in a standard Gardner color apparatus. The ASTM color was determined using the ASTM D1500-96 procedure, using a composite acid layer from several RCS determinations.

From the data shown in Table IV, it can be seen that both feeds were highly contaminated, with an RCS value of 12.5 (Gardner color) for the 100 Neutral lube base stock and RCS value of up to 18 (Gardner color) for the 500 Neutral lube base stock. With these feeds, the bauxite sorbent did not reduce the RCS value to any significant extent, even with only 6 hours of treatment, using fresh bauxite. TONSIL clay, on the other hand, produced acceptable white oil product for up to 46–48 hours under the same experimental conditions.

Example 2

A number of clay sorbents were further tested using 100 Neutral Lube Base Stocks and two different 500 Neutral Technical White Oil samples. Results are tabulated in Table V. The 100 Neutral Lube Base Stock was particularly difficult to treat. The only sorbent producing an acceptable white oil (Gardner color less than 11.0) was a combination of Porocel 20/60 bauxite and TONSIL CO 630G, at a low feed rate.

Only three of the sorbents tested with 500 Neutral Technical White Oil A produced acceptable white oil product: TONSIL CO 630G for at least 46–48 hours, TONSIL 616 for at least 26–28 hours and the hydrotreating catalyst sample for at least 18 hours. The rest produced oils having an RCS value all greater than 11.0.

The second test, with 500 Neutral Technical White Oil B at a slightly higher temperature and oil feed rate, compares the effectiveness of F-24 ( formerly Filtrol 24), another montmorillonite which is commonly used for decolorizing white oils, with the present clay sorbent. Bauxite alone did not produce an acceptable white oil. TONSIL CO 630G produced an acceptable white oil for at least 22-24 hours. The combination of bauxite (Porocel 20/60) with TONSIL CO 630G produced an acceptable white oil for at least 36 hours. The combination of bauxite with F-24 did not produce acceptable white oil at 26-28 hours. This example clearly shows the superiority of the sorbent of this invention over F-24.

TABLE IV

| | Adsorbent | | | Gradner Color (ASTM Color) after Treatment for Indicated Time, hrs | | | | | | | | | |
|---|---|---|---|---|---|---|---|---|---|---|---|---|---|
| Run | First Bed | Second Bed | Temperature | No Treat | 6 | 12 | 18 | 22–24 | 30–32 | 36 | 42 | 46–48 | 72 |
| | | | | Feed: 500 Neutral Lube Base Stock | | | | | | | | | |
| 1 | Bauxite | Bauxite | Ambient | 18 (7.5) | | | | | | | | 17 | |
| 2 | Bauxite | Bauxite | Ambient | 16 | 14.5 | 15.5 | | | | | | | |
| 3 | | TONSIL CO 630 G | Ambient | 15.5 (from run 1) | | | 4.5 | 5 | 6.5 | | | 10 | |
| 4 | Bauxite | TONSIL CO 630 G | Ambient | 17 (7.5) | | | | | 7 (3–3.5) | | | | |
| 5 | Bauxite | TONSIL CO 630 G | Ambient | 16 (6–6.5) | | | | 6 (2–2.5) | 9 | 10 | 12 | | |
| 6 | Bauxite | TONSIL CO 630 G | 110° F. | 16 (6–6.5) | | | | 4.5 | | 8.5 | 10.5 | 12.5 | |

TABLE IV-continued

| | Adsorbent | | | Gradner Color (ASTM Color) after Treatment for Indicated Time, hrs | | | | | | | | | |
|---|---|---|---|---|---|---|---|---|---|---|---|---|---|
| Run | First Bed | Second Bed | Temperature | No Treat | 6 | 12 | 18 | 22–24 | 30–32 | 36 | 42 | 46–48 | 72 |
| | | | | Feed: 100 Neutral Lube Base Stock | | | | | | | | | |
| 7 | None | TONSIL CO 630 G | Ambient | 12.5 (4–4.5) | | | | 3.5 | | | | 9.5 | 12.5 |

Example 3

FIG. 1 shows the result of a test to determine the capacity of various clays for producing an acceptable white oil product. Each sorbent was tested as follows. 75 grams of the sorbent clay was charged to a cylindrical container. The white oil feedstock was a 100 Neutral lube base oil which had been produced by hydrocracking a VGO, dewaxing the hydrocrackate to a pour point of less than 0° C. and hydrogenating the dewaxed oil with a platinum/palladium containing hydrogenation catalyst. Each sample of the white oil feedstock, having a RCS Gardner color value of 12.0, was passed through the clay at 12 drops/minute at a temperature of 78° F. Samples of filtered oil were collected periodically and tested in the RCS test, using the Gardner color scale to determine the color of the acid extract from the test. The color of the extract is plotted against filtering time for each sorbent in FIG. 1. An RCS Gardner color value of 11.0 or less is considered to be acceptable. Oils giving an RCS Gardner color value of 11.5 or greater is considered off-spec. Four sorbents were tested: TONSIL CO 614G, TONSIL CO 616G, TONSIL CO 630G, and F-24. The data shows that TONSIL CO 630G gave RCS Gardner color values as low as 5.5, and gave acceptable product up to over 12,000 gallons oil filtered/ton clay used. None of the other sorbents gave product with an RCS Gardner color value of less than 8.5, and none treated more than 7,000 gallons oil/ton clay before failing. F-24 was the least effective sorbent of the four tested, treating only 4000 gallons oil/ton clay before becoming saturated. Clearly, the TONSIL CO 630G was superior to the other sorbents, both in terms of the low color value relative to other sorbents through the entire test, and also for the extended useful life of the TONSIL CO 630G before the product was no longer acceptable white oil (i.e. Gardner color greater than 11.0). This data clearly shows the surprising effectiveness of TONSIL CO 630G for producing a USP grade white oil from a highly contaminated feed.

TABLE V

| Adsorbent | | Gardner Color (ASTM Color) after Treatment for Indicated Time, hrs | | | | | | | | | | |
|---|---|---|---|---|---|---|---|---|---|---|---|---|
| First Bed | Second Bed | No Treat | 4–6 | 12 | 18 | 22–24 | 26–28 | 30–32 | 36 | 40–42 | 46–48 | 72 |
| | | Feed: 100 Neutral Lube Base Stock (Ambient temp, 9 drops/min) | | | | | | | | | | |
| | Porocel 20/60 | 16 | | | | | | | | | | |
| | TONSIL CO 630 G | 16 | | | | 12.5 | | | | | | |
| Porocel 20/60 | TONSIL CO 630 G | 16 | | | | 12.5 | | | | | | |
| Porocel 20/60 | TONSIL CO 630 G | 16 | (6 drops/min) | | | | | | | | 7.5 | |
| | | 500 Neutral Technical White Oil A (Ambient temp, 9 drops/min) | | | | | | | | | | |
| | Porocel 20/60 | 16 | | 14.5 | | | | | | | | |
| | Florosil | 16 | | 12.5 | | | | | | | | |
| | Attapulgus | 16 | | 18+ | | | | | | | | |
| Porocel 20/60 | Florosil | 16 | 11.5 | | | | | | | | | |
| Porocel 20/60 | Activated Carbon | 16 | | | 18 | | | | | | | |
| Porocel 20/60 | TONSIL CO 630 G | 16 | | | | | | | | | 10 | |
| Porocel 20/60 | Hydrotreating Catalyst | 16 | | | 10 | | | | | | | |
| Porocel 20/60 | TONSIL 616 | 16 | | | | | 10 | | | | | |
| Porocel 20/60 | Alcoa SLD 350 | 16 | 13 | | | | | | | | | |
| | | 500 Neutral Technical White Oil B (110° F., 12 drops/min) | | | | | | | | | | |
| | Porocel 20/60 | (7.5) | | | | | | | | 15.0 (6.0) | | |
| | TONSIL CO 630 G | (7.5) | | | | 6.5 | | | | | | |
| Porocel 20/60 | TONSIL CO 630 G | (7.5) | | | | | | | 7 | | | |
| Porocel 20/60 | F-24 | (7.5) | | | | | 11.5 | | | | | |

What is claimed is:

1. A process for preparing a white oil comprising filtering a white oil feedstock through a filter bed containing an acid-activated clay to produce a white oil, wherein the white oil feedstock, when subjected to the RCS test, produces an acid extract having an ASTM D1500 color of greater than 4.5, and wherein the white oil, when subjected to the RCS test, produces an acid extract having an ASTM D1500 color of 2.5 or less.

2. The process according to claim 1 wherein the white oil feedstock, when subjected to the RCS test, produces an acid extract having an ASTM D1500 color of greater than 5.0.

3. The process according to claim 2 wherein the white oil feedstock, when subjected to the RCS test, produces an acid extract having an ASTM D1500 color of greater than 6.0.

4. The process according to claim 1 wherein the acid-activated clay is an acid-activated calcium bentonite.

5. The process according to claim 4 wherein the acid-activated calcium bentonite clay has the following properties:

| | |
|---|---|
| Bulk density, g/l | 400–700 |
| Free moisture (2 h, 110° C.), % max | <8% |
| Loss on ignition (2 h, 1000° C.), % max | <12% |
| pH (10% suspension, filtered) | 2.0–4.0 |
| Free Acidity, mg KOH/g | 2.5–3.5 |
| Total Acidity, mg KOH/g | 7.0–13.0 |
| Surface area, $m^2/g$ | 150–350 |
| Micropore volume (0–80 nm), ml/g | 0.20–0.40 |
| Particle size | >90% through 16 mesh (1 mm)<br><10% through 80 mesh (180 μm) |

6. The process according to claim 5 wherein the acid-activated clay has the following properties:

TABLE II

| | |
|---|---|
| Physical Properties | |
| Bulk density, g/l | 500–600 g/l |
| Free moisture(2 h, 110° C.), % | <6% |
| Loss on ignition (2 h, 1000° C.), | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2g$ | 230–250 m |
| Micropore volume (0–80 nm), | 0.30–0.35 |
| Particle size | >90 wt % through 20 mesh (850 μm)<br><10% through 60 mesh (250 μm) |
| Chemical Analysis (average values) | |
| $SiO_2$ | 71.86% |
| $Al_2O_3$ | 14.07% |
| $Fe_2O_3$ | 2.75% |
| CaO | 0.64% |
| MgO | 1.46% |
| $Na_2O$ | 0.08% |
| $K_2O$ | 0.66% |
| Loss on ignition | 6.65% |
| Total | 98.17% |

7. The process according to claim 1 wherein the white oil feedstock is recovered from a clay filter pretreatment stage using a regenerable sorbent.

8. The process according to claim 7 wherein the regenerable sorbent is bauxite.

9. The process according to claim 1 wherein the white oil feedstock is a technical grade white oil.

10. The process according to claim I wherein the white oil meets the test requirements of the United States Pharmacopeai XXX (1980) for readily carbonizable substances.

11. The process according to claim 10 wherein the white oil is a USP grade white oil.

12. The process according to claim 1 wherein the white oil is a USP grade white oil.

13. The process according to claim 1 wherein the white oil feedstock is prepared by contacting a mineral oil feedstock and hydrogen at hydrogenation reaction conditions with a hydrogenation catalyst comprising a platinum-palladium alloy and an oxide matrix, wherein the platinum to palladium molar ratio in the alloy is between 2.5:1 to 1:10.

14. The process according to claim 13 wherein the acid-activated clay is an acid-activated calcium bentonite.

15. The process according to claim 14 wherein the acid-activated calcium bentonite has the following properties:

| | |
|---|---|
| Bulk density | 450–650 g/l |
| Free moisture (2 h, 110° C.), % max | <8% |
| Loss on ignition (2 h, 1000° C.), % | <12% |
| pH (10% suspension, filtered) | 2.2–3.2 |
| Free Acidity | 2.5–3.5 mg KOH/g |
| Total Acidity, mg KOH/g | 8.0–13.0 mg |
| Surface area | 200–300 $m^2/g$ |
| Micropore volume (0–80 nm) | 0.25–0.40 ml/g |

16. The process according to claim 15 wherein the acid-activated clay has the following properties:

TABLE II

| | |
|---|---|
| Physical Properties | |
| Bulk density, g/l | 500–600 g/l |
| Free moisture (2 h, 110° C.), % | <6% |
| Loss on ignition (2 h, 1000° C.), | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2/g$ | 230–250 m |
| Micropore volume (0–80 nm), | 0.30–0.35 |
| Particle size | >90 wt % through 20 mesh (850 μm)<br><10% through 60 mesh (250 μm) |
| Chemical Analysis (average values) | |
| $SiO_2$ | 71.86% |
| $Al_2O_3$ | 14.07% |
| $Fe_2O_3$ | 2.75% |
| CaO | 0.64% |
| MgO | 1.46% |
| $Na_2O$ | 0.08% |
| $K_2O$ | 0.66% |
| Loss on ignition | 6.65% |
| Total | 98.17% |

17. The process according to claim 1 wherein the acid-activated clay has the following properties:

TABLE II

| | |
|---|---|
| Physical Properties | |
| Bulk density, g/l | 500–600 g/l |
| Free moisture(2 h, 110° C.), % | <6% |
| Loss on ignition (2 h, 1000° C.), | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2g$ | 230–250 m |
| Micropore volume (0–80 nm), | 0.30–0.35 |
| Particle size | >90 wt % through 20 mesh (850 μm)<br><10% through 60 mesh (250 μm) |
| Chemical Analysis (average values) | |
| $SiO_2$ | 71.86% |
| $Al_2O_3$ | 14.07% |

TABLE II-continued

| | |
|---|---|
| $Fe_2O_3$ | 2.75% |
| CaO | 0.64% |
| MgO | 1.46% |
| $Na_2O$ | 0.08% |
| $K_2O$ | 0.66% |
| Loss on ignition | 6.65% |
| Total | 98.17% |

18. A process for preparing a white oil comprising:

a) contacting a mineral oil feedstock in a first sorbent stage with a regenerable sorbent to produce a white oil feedstock which, when subjected to the RCS test, produces an acid extract having an ASTM D1500 color of greater than 4.5; and b) contacting the white oil feedstock from step a) with a non-regenerable acid-activated clay to produce a white oil which, when subjected to the RCS test, produces an acid extract having an ASTM D1500 color of less than about 2.5.

19. The process according to claim 18 wherein the acid-activated clay is an acid-activated calcium bentonite.

20. The process according to claim 19 wherein the acid-activated calcium bentonite has the following properties:

| | |
|---|---|
| Bulk density | 450–650 g/l |
| Free moisture (2 h, 110° C.), % max | <8% |
| Loss on ignition (2 h, 1000° C.), % | <12% |
| pH (10% suspension, filtered) | 2.2–3.2 |
| Free Acidity | 2.5–3.5 mg KOH/g |
| Total Acidity, mg KOH/g | 8.0–13.0 mg |
| Surface area | 200–300 $m^2/g$ |
| Micropore volume (0–80 nm) | 0.25–0.40 ml/g |

21. The process according to claim 20 wherein the acid-activated clay has the following properties:

TABLE II

| Physical Properties | |
|---|---|
| Bulk density, g/l | 500–600 g/l |
| Free moisture (2 h, 110° C.), % | <6% |
| Loss on ignition (2 h, 1000° C.), | <10% |
| pH (10% suspension, filtered) | 2.4–3.0 |

TABLE II-continued

| | |
|---|---|
| Free Acidity, mg KOH/g | 2.7–3.3 |
| Total Acidity, mg KOH/g | 9.0–12.0 |
| Surface area, $m^2/g$ | 230–250 m |
| Micropore volume (0–80 nm), | 0.30–0.35 |
| Particle size | >90 wt % through 20 mesh (850 μm) <10% through 60 mesh (250 μm) |
| Chemical Analysis (average values) | |
| $SiO_2$ | 71.86% |
| $Al_2O_3$ | 14.07% |
| $Fe_2O_3$ | 2.75% |
| CaO | 0.64% |
| MgO | 1.46% |
| $Na_2O$ | 0.08% |
| $K_2O$ | 0.66% |
| Loss on ignition | 6.65% |
| Total | 98.17% |

22. The process according to claim 18 wherein the regenerable sorbent is bauxite.

23. The process according to claim 18 wherein the white oil feedstock is a technical grade white oil and the white oil is a USP grade white oil.

24. A process for preparing a USP grade white oil comprising passing a white oil feedstock through a filter bed comprising an acid-activated calcium bentonite having the following properties:

| | |
|---|---|
| Bulk density, g/l | 500–600 g/l |
| Free moisture (2 h, 110° C.), % max | <6% |
| Loss on ignition (2 h, 1000° C.), % | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2g$ | 230–250 m |
| Micropore volume (0–80 nm), ml/g | 0.30–0.35 |

to produce a white oil which, when subjected to the RCS test, produces an acid extract having an ASTM D1500 color of 2.5 or less.

25. The process according to claim 24 wherein the white oil feedstock is a technical grade white oil and wherein the white oil is a USP grade white oil.

* * * * *